US009200511B2

(12) United States Patent
Hon et al.

(10) Patent No.: US 9,200,511 B2
(45) Date of Patent: Dec. 1, 2015

(54) ENHANCED DYNAMIC WELL MODEL FOR RESERVOIR PRESSURE DETERMINATION

(75) Inventors: Vai Yee Hon, Kajang (MY); Suzalina Bt Zainal, Kajang (MY)

(73) Assignee: Petroliam Nasional Berhad, Kuala Lumpur (MY)

( * ) Notice: Subject to any disclaimer, the term of this patent is extended or adjusted under 35 U.S.C. 154(b) by 868 days.

(21) Appl. No.: 13/510,281

(22) PCT Filed: Nov. 15, 2010

(86) PCT No.: PCT/MY2010/000280

§ 371 (c)(1),
(2), (4) Date: Aug. 3, 2012

(87) PCT Pub. No.: WO2011/062474

PCT Pub. Date: May 26, 2011

(65) Prior Publication Data

US 2012/0303281 A1 Nov. 29, 2012

(30) Foreign Application Priority Data

Nov. 17, 2009 (MY) ..... 20094877

(51) Int. Cl.
*E21B 47/06* (2012.01)

(52) U.S. Cl.
CPC ..... *E21B 47/06* (2013.01)

(58) Field of Classification Search
CPC ..... G01V 9/00; E21B 47/06
USPC ..... 702/12
See application file for complete search history.

(56) References Cited

U.S. PATENT DOCUMENTS 6,836,731 B1 12/2004 Whalley et al.
2010/0236776 A1 * 9/2010 Spross et al. ..... 166/250.02

FOREIGN PATENT DOCUMENTS

RU 2055179 2/1996
RU 2301886 6/2007

OTHER PUBLICATIONS

Mattar et al., 'The "flowing" gas material balance', The Journal of Canadian Petroleum Technology, Feb. 1988, vol. 37, No. 2, pp. 52-55.
International Preliminary Report on Patentability dated May 22, 2012 for PCT Application No. PCT/MY2010/000280 in 5 pages.

* cited by examiner

*Primary Examiner* — Bryan Bui
(74) *Attorney, Agent, or Firm* — Knobbe Martens Olson & Bear LLP

(57) ABSTRACT

A computer implemented method for determining reservoir pressure in a shut-in well, the method comprising: determining the initial physical characteristics of the well; determining properties of gas bubble throughout the well; calculating a dynamic mass transfer rate for the gas bubble over a period of time; calculating the physical fluid movement along the well: calculating a rate of fluid influx from the reservoir; determining a corrected pressure gradient along at least part, or all, of the profile of the well using the determined dynamic mass transfer rate, fluid movement and rate of fluid influx; and determining the reservoir pressure from a measure, or determination, of the well head pressure and the calculated pressure.

21 Claims, 7 Drawing Sheets

| Shape factor Number | 1 | 2 | 3 | 4 | 5 | 6 | 7 | 8 | 9 |
|---|---|---|---|---|---|---|---|---|---|
| Dimensionless Time | MBH Dimensionless Pressure Drop | | | | | | | | |
| tDA |  |  |  |  |  |  |  |  |  |
| 0.0010 | 0.0126 | 0.0126 | 0.0126 | 0.0126 | 0.0126 | 0.0126 | 0.0126 | 0.0126 | 0.0125 |
| 0.0015 | 0.0188 | 0.0188 | 0.0188 | 0.0188 | 0.0188 | 0.0188 | 0.0188 | 0.0188 | 0.0179 |
| 0.0020 | 0.0251 | 0.0251 | 0.0251 | 0.0251 | 0.0251 | 0.0251 | 0.0251 | 0.0251 | 0.0209 |
| 0.0025 | 0.0314 | 0.0314 | 0.0314 | 0.0311 | 0.0314 | 0.0314 | 0.0314 | 0.0314 | 0.0103 |
| 0.0030 | 0.0377 | 0.0377 | 0.0377 | 0.0368 | 0.0377 | 0.0377 | 0.0377 | 0.0377 | 0.0160 |
| 0.0040 | 0.0503 | 0.0503 | 0.0503 | 0.0400 | 0.0503 | 0.0502 | 0.0503 | 0.0502 | -0.0019 |
| 0.0050 | 0.0628 | 0.0628 | 0.0628 | 0.0517 | 0.0628 | 0.0676 | 0.0628 | 0.0626 | -0.0264 |
| 0.0060 | 0.0754 | 0.0754 | 0.0754 | 0.0537 | 0.0754 | 0.0745 | 0.0754 | 0.0745 | -0.0596 |
| 0.0070 | 0.0880 | 0.0880 | 0.0879 | 0.0524 | 0.0880 | 0.0858 | 0.0880 | 0.0858 | -0.0932 |
| 0.0080 | 0.1005 | 0.1005 | 0.1004 | 0.0483 | 0.1005 | 0.0963 | 0.1005 | 0.0963 | -0.1277 |
| 0.0090 | 0.1131 | 0.1130 | 0.1128 | 0.0422 | 0.1131 | 0.1059 | 0.1131 | 0.1059 | -0.1620 |
| 0.0100 | 0.1257 | 0.1254 | 0.1251 | 0.0345 | 0.1257 | 0.1145 | 0.1257 | 0.1145 | -0.1957 |
| 0.0150 | 0.1885 | 0.1664 | 0.1823 | -0.0162 | 0.1884 | 0.1419 | 0.1884 | 0.1449 | -0.3468 |
| 0.0200 | 0.2513 | 0.2402 | 0.2287 | -0.0700 | 0.2508 | 0.1601 | 0.2505 | 0.1698 | -0.4670 |
| 0.0250 | 0.3141 | 0.2892 | 0.2630 | -0.1181 | 0.3119 | 0.1678 | 0.3107 | 0.1663 | -0.5615 |
| 0.0300 | 0.3769 | 0.3333 | 0.2864 | -0.1584 | 0.3708 | 0.1773 | 0.3676 | 0.1683 | -0.6357 |
| 0.0400 | 0.5016 | 0.4108 | 0.3067 | -0.2166 | 0.4804 | 0.1812 | 0.4656 | 0.1657 | -0.7395 |
| 0.0500 | 0.6237 | 0.4791 | 0.3099 | -0.2512 | 0.5785 | 0.1955 | 0.5511 | 0.1593 | -0.8012 |
| 0.0600 | 0.7415 | 0.5413 | 0.3002 | -0.2694 | 0.6667 | 0.2169 | 0.6167 | 0.1513 | -0.8339 |
| 0.0700 | 0.8537 | 0.5991 | 0.2856 | -0.2766 | 0.7471 | 0.2450 | 0.6683 | 0.1428 | -0.8457 |
| 0.0800 | 0.9597 | 0.6531 | 0.2700 | -0.2765 | 0.8217 | 0.2767 | 0.7085 | 0.1346 | -0.8322 |
| 0.0900 | 1.0592 | 0.7038 | 0.2553 | -0.2716 | 0.8917 | 0.3167 | 0.7398 | 0.1269 | -0.8272 |
| 0.1000 | 1.1524 | 0.7516 | 0.2427 | -0.2633 | 0.9581 | 0.3581 | 0.7642 | 0.1198 | -0.8038 |
| 0.1500 | 1.5364 | 0.9583 | 0.2226 | -0.1951 | 1.2524 | 0.5864 | 0.8261 | 0.0954 | -0.6223 |
| 0.2000 | 1.8212 | 1.1314 | 0.2637 | -0.1027 | 1.4987 | 0.8106 | 0.8476 | 0.0873 | -0.4136 |
| 0.2500 | 2.0439 | 1.2854 | 0.3412 | 0.0025 | 1.7064 | 1.0104 | 0.8629 | 0.0923 | -0.2196 |
| 0.3000 | 2.2262 | 1.4257 | 0.4366 | 0.1129 | 1.8830 | 1.1841 | 0.8829 | 0.1087 | -0.0479 |
| 0.4000 | 2.5139 | 1.6720 | 0.6400 | 0.3308 | 2.1678 | 1.4674 | 0.9447 | 0.1687 | 0.2343 |
| 0.5000 | 2.7370 | 1.8797 | 0.8321 | 0.5268 | 2.3905 | 1.6899 | 1.0299 | 0.2537 | 0.4567 |
| 0.6000 | 2.9193 | 2.0563 | 1.0028 | 0.6994 | 2.5728 | 1.8722 | 1.1280 | 0.3518 | 0.6369 |
| 0.7000 | 3.0735 | 2.2083 | 1.1527 | 0.8499 | 2.7269 | 2.0263 | 1.2307 | 0.4545 | 0.7931 |
| 0.8000 | 3.2070 | 2.3411 | 1.2847 | 0.9821 | 2.8605 | 2.1599 | 1.3329 | 0.5567 | 0.9267 |
| 0.9000 | 3.3249 | 2.4586 | 1.4019 | 1.0994 | 2.9782 | 2.2776 | 1.4315 | 0.6552 | 1.0444 |
| 1.0000 | 3.4302 | 2.5638 | 1.5070 | 1.2045 | 3.0836 | 2.3830 | 1.5252 | 0.7489 | 1.1497 |
| 2.0000 | 4.1234 | 3.2569 | 2.2000 | 1.8976 | 3.7768 | 3.0762 | 2.2002 | 1.4239 | 1.8430 |
| 4.0000 | 4.8166 | 3.9501 | 2.8933 | 2.5905 | 4.4701 | 3.7695 | 2.8932 | 2.1170 | 2.5363 |
| 8.0000 | 5.5099 | 4.6435 | 3.5867 | 3.2864 | 5.1633 | 4.4627 | 3.5866 | 2.6103 | 3.2500 |
| 10.0000 | 5.7331 | 4.8667 | 3.8098 | 3.5073 | 5.3865 | 4.6859 | 3.8098 | 3.0335 | 3.4800 |

| Shape factor Number | 10 | 11 | 12 | 13 | 14 | 15 | 16 | 17 |
|---|---|---|---|---|---|---|---|---|
| Dimensionless Time | | | | | | | | |
| tDA |  |  |  |  |  |  |  |  |
| 0.0010 | 0.0126 | 0.0125 | 0.0126 | 0.0126 | 0.0126 | 0.0126 | 0.0126 | 0.0126 |
| 0.0015 | 0.0168 | 0.0179 | 0.0168 | 0.0186 | 0.0148 | 0.0188 | 0.0168 | 0.0188 |
| 0.0020 | 0.0251 | 0.0208 | 0.0251 | 0.0251 | 0.0251 | 0.0251 | 0.2510 | 0.0251 |
| 0.0025 | 0.0314 | 0.0200 | 0.0314 | 0.0311 | 0.0314 | 0.0311 | 0.0314 | 0.0311 |
| 0.0030 | 0.0376 | 0.0155 | 0.0377 | 0.0368 | 0.0377 | 0.3680 | 0.0377 | 0.3680 |
| 0.0040 | 0.0502 | -0.0027 | 0.0503 | 0.0460 | 0.0503 | 0.0460 | 0.0503 | 0.0460 |
| 0.0050 | 0.0626 | -0.0295 | 0.0678 | 0.0517 | 0.0628 | 0.0517 | 0.0628 | 0.0517 |
| 0.0060 | 0.0745 | -0.0617 | 0.0754 | 0.0537 | 0.0754 | 0.5370 | 0.0753 | 0.5370 |
| 0.0070 | 0.0658 | -0.0951 | 0.0879 | 0.0524 | 0.0879 | 0.0524 | 0.0878 | 0.0524 |
| 0.0080 | 0.9620 | -0.1296 | 0.1004 | 0.0483 | 0.1004 | 0.0483 | 0.1000 | 0.0483 |
| 0.0090 | 0.1050 | -0.1644 | 0.1129 | 0.0422 | 0.1129 | 0.0422 | 0.0009 | 0.0422 |
| 0.0100 | 0.1144 | -0.1983 | 0.1251 | 0.0345 | 0.1251 | 0.0345 | 0.1234 | 0.0100 |
| 0.0150 | 0.1445 | -0.3502 | 0.1823 | -0.0162 | 0.1823 | -0.0167 | 0.1713 | 0.0080 |
| 0.0200 | 0.1589 | -0.4718 | 0.2291 | -0.0701 | 0.2291 | -0.0701 | 0.2015 | -0.0020 |
| 0.0250 | 0.1641 | -0.5695 | 0.2643 | -0.1156 | 0.2634 | -0.1187 | 0.2163 | -0.0100 |
| 0.0300 | 0.1633 | -0.6507 | 0.2897 | -0.1600 | 0.2897 | -0.1600 | 0.2200 | -0.2200 |
| 0.0400 | 0.1492 | -0.7839 | 0.3197 | -0.2231 | 0.3194 | -0.2235 | 0.2075 | -0.0450 |
| 0.0500 | 0.1224 | -0.8955 | 0.3332 | -0.2652 | 0.3315 | -0.2667 | 0.1820 | -0.6000 |
| 0.0600 | 0.0867 | -0.9969 | 0.3385 | -0.2957 | 0.3335 | -0.3018 | 0.1516 | -0.8000 |
| 0.0700 | 0.0636 | -1.0949 | 0.3399 | -0.3156 | 0.3290 | -0.3278 | 0.1703 | -1.0000 |
| 0.0800 | -0.0078 | 1.1000 | 0.3404 | -0.3291 | 0.3199 | -0.3510 | 0.0899 | -1.2000 |
| 0.0900 | -0.0512 | -1.2723 | 0.3403 | -0.3375 | 0.3072 | -0.3727 | 0.0613 | -1.4000 |
| 0.1000 | -0.1004 | -1.3542 | 0.3412 | -0.3421 | 0.2915 | -0.3947 | 0.0315 | -1.6000 |
| 0.1500 | -0.3322 | -1.7021 | 0.3663 | -0.3257 | 0.1826 | -0.5128 | -0.0580 | -2.2500 |
| 0.2000 | -0.5189 | -1.9613 | 0.4269 | -0.2661 | 0.0468 | -0.6499 | -0.0935 | -2.6000 |
| 0.2500 | -0.6580 | -2.1508 | 0.5120 | -0.1811 | -0.0959 | -0.7928 | -0.0855 | -2.7500 |
| 0.3000 | -0.7555 | -2.2854 | 0.6102 | -0.0829 | -0.2344 | -0.9312 | -0.0477 | -2.8000 |
| 0.4000 | -0.8547 | -2.4344 | 0.8152 | 0.1270 | -0.4769 | -1.1758 | 0.0773 | -2.9000 |
| 0.5000 | -0.8871 | -2.4768 | 1.0075 | 0.3183 | -0.6712 | -1.3681 | 0.2268 | -2.8800 |
| 0.6000 | -0.8264 | -2.4564 | 1.1783 | 0.4852 | -0.8134 | -1.5103 | 0.3753 | -2.7800 |
| 0.7000 | -0.7620 | -2.4011 | 1.3282 | 0.6351 | -0.9129 | -1.6098 | 0.5143 | -2.7000 |
| 0.8000 | -0.6820 | -2.3278 | 1.4602 | 0.7670 | -0.9775 | -1.6744 | 0.6409 | -2.6000 |
| 0.9000 | -0.5969 | -2.2469 | 1.5774 | 0.5843 | -1.0145 | -1.7114 | 0.7655 | -2.4800 |
| 1.0000 | -0.5115 | -2.1640 | 1.6825 | 0.9894 | -1.0301 | -1.7270 | 0.8595 | -2.3000 |
| 2.0000 | 0.1507 | -1.5058 | 2.3755 | 1.6824 | -0.7325 | -1.4294 | 1.5516 | -1.7000 |
| 4.0000 | 0.8836 | -0.6524 | 3.1688 | 2.2857 | -0.0800 | -0.7500 | 2.2500 | -0.0980 |
| 8.0000 | 1.5400 | -0.0800 | 3.7500 | 3.0150 | 0.6500 | -0.0200 | 2.9000 | -0.2500 |
| 10.0000 | 1.7800 | 0.1200 | 4.0000 | 3.2800 | 0.9000 | 0.2000 | 3.1800 | -0.0500 |

ENHANCED DYNAMIC WELL MODEL FOR RESERVOIR PRESSURE DETERMINATION

CROSS REFERENCE TO RELATED APPLICATIONS

This application claims the benefit and priority to and is a U.S. National Phase Application of PCT International Application Number PCT/MY2010/000280, filed on Nov. 15, 2010, designating the United States of America and published in the English language, which is an International Application of and claims the benefit of priority to Malaysian Patent Application No. PI 20094877, filed on Nov. 17, 2009. The disclosures of the above-referenced applications are hereby expressly incorporated by reference in their entireties.

FIELD OF INVENTION

The invention relates to the modeling of physical conditions during shut-in of an oil well, in order to improve bottom-hole data determination, especially the bottom-hole reservoir pressure.

BACKGROUND TO THE INVENTION

In the field of oil drilling and excavation, the bottom-hole refers to the base of the well. Accurate bottom-hole data is important to manage the reservoir and to ensure that a well is enabled to deliver more oil. Additionally, accurate bottom-hole data can be used to increase the efficiencies in production planning and recovery. Therefore, it is desirable to be able to obtain accurate bottom-hole data as decisions on the productivity of a well are made using such data.

Phase redistribution is observed in oil and gas wells during shut-in, where the oil and gas separate in the wellbore. An example of the physical characteristics of a well in steady-state and shut-in are shown in FIG. 6. The accuracy of pressure change calculation during shut-in depends on how accurately the gas and oil mixture gradient are modeled. A parameter of the fluid mixture gradient is the distribution of gas and liquid phases in the wellbore.

If a good dynamic well model can be built to describe the complex mechanisms occurring during the transient well shut-in period from the semi steady-state well flowing period, some key well parameters can be obtained with more certainty. These parameters would include the reservoir pressure, well productivity index and skin, giving the operator great economic benefits.

However, the acquisition of bottom-hole data can be difficult and expensive. It is known to obtain bottom-hole data from permanent downhole gauges or through well intervention measurement. However, permanent downhole gauges are often expensive and unreliable whereas well intervention measurements are by their very nature are intrusive. Furthermore, the use of well intervention measurements often leads to well downtime to remove the often stuck instruments inside the well, or in a process known as "fishing".

It is also known to use PVT (pressure, volume, temperature) modeling, along with surface data, in order to provide an estimate of the conditions within the well. However, such models are known to be of limited accuracy. In particular they are unable to model the phase transitions in wells accurately as they assume an instantaneous phase transition between gas and oil.

In a shut-in well, one which has closed off, unlike a producing steady-state well, phase distribution is known to occur, where the gas and oil separate. By accurately modeling the transition, accurate values of key parameters such as reservoir pressure may be obtained. However, unlike during the steady-state of the well, the contents are undergoing a phase transition making the modeling considerably more complex.

During the $11^{th}$ European Conference on the Mathematics of oil recovery, September 2008, a paper was presented by Hon Vai Yee et al., outlining a workflow for subsurface data determination. The present invention discloses improvements to the workflow in order to model more accurately the bottom-hole reservoir pressure.

Therefore, it is an object of the invention to provide a non-evasive method of determining the physical parameters within a shut-in well, in particular the determination of the bottom-hole reservoir pressure.

In order to mitigate at least some of the above problems, there is provided a computer implemented method according to claim 1.

Further aims and aspects of the invention will be apparent from the appended claims.

BRIEF DESCRIPTION OF THE DRAWINGS

An embodiment of the invention is now described, by way of example only, with reference to the accompanying drawing in which:

FIG. 6 is a depth versus pressure diagram of a well in steady-state and shut-in.

DETAILED DESCRIPTION OF AN EMBODIMENT

In order to obtain accurate bottom-hole modeling data, without the use of downhole instrumentation, the applicants have beneficially realised that such data may be obtained by producing an accurate model of the transient well behaviour from steady-state to shut-in. This allows for an accurate determination of the physical characteristics, in particular the reservoir pressure to be made. Furthermore, the accuracy of these models can be easily verified by comparing the values of, say, pressure at the top of the wellbore with the actual measured value.

The following description relates to the methods used in the implementation of a computer program to model the well and bottom-hole behaviour during phase distribution in a shut-in well. The skilled man will realise that the implementation of such methods may be achieved using known numerical simulation techniques and mathematical libraries.

Figure 1:
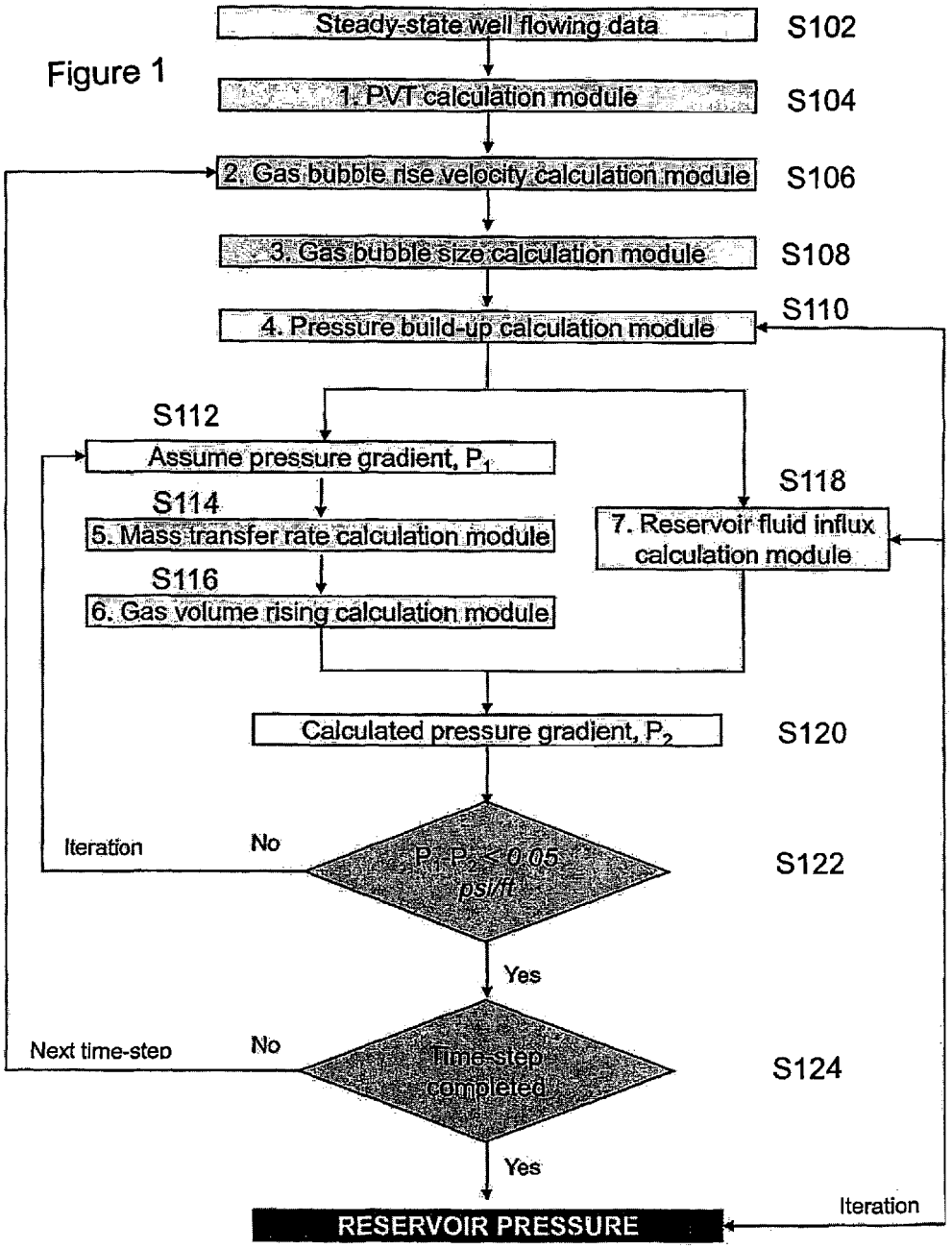
FIG. 1 is a flow diagram of the overall process of determining the reservoir pressure.

FIG. 1 is a flow diagram of the overall process of calculating the reservoir pressure from a shut-in well. There is shown the steps of determining: the steady-state well flowing conditions at step S102; the PVT relationships of the well at step S104; the gas bubble rise velocity at step S106; the gas bubble size at step S108; the pressure build-up at step S110; assuming a first pressure gradient $P_1$ at step S112; the mass transfer rate at step S114; the gas volume rising distribution at step S116; the reservoir fluid influx at step S118; a pressure gradient at S120; checking the convergence between S112 and S120 at step S122; checking if the an equilibrium condition has been met which the time step has been completed at step S124 and determining the reservoir pressure at step S126.

When a well is open, it will be in a steady-state. The behaviour of an oil well in steady-state is well understood (see for example Orkiszemski 1967). At step S102 the fluid parameters in the steady-state are determined using known numerical calculations. This data is important as it forms the initial conditions of the data required to accurately model the well during shut-in.

Before shut-in, it is assumed that the fluid flow in the wellbore is at steady-state condition. A steady-state calculation is completed to gather the fluid parameters describing their properties required for the shut-in calculation.

In a steady-state, the fluid flowing in a wellbore will experience pressure losses. The pressure losses, dp/dl, can be broken into three different components namely 1) hydrostatic pressure loss, (dp/dl)hyd, 2) kinetic pressure loss, (dp/dl)acc, and 3) frictional pressure loss, (dp/dl)f.

$$\frac{dp}{dl} = \left(\frac{dp}{dl}\right)_{hyd} + \left(\frac{dp}{dl}\right)_{acc} + \left(\frac{dp}{dl}\right)_{f} \tag{1}$$

In a wellbore, the kinetic losses are generally minimal and can be ignored. The frictional losses are due to a combination of the particular flow regime that the fluid can be considered to be travelling in as well as the composition of the fluid. The hydrostatic pressure losses are a function of the fluid mixture density that exists in the wellbore. The hydrostatic pressure difference is the component of pressure loss attributed to the Earth's gravitational effect. In the hydrostatic pressure loss equation, it is important to obtain an appropriate value for wellbore's liquid density. For multi-phase flow, this hydrostatic pressure is calculated from the in-situ mixture density, which depends on the liquid hold-up. The liquid hold-up is obtained from multi-phase flow correlations, and it is dependant on the gas and liquid rates, pipe diameter, etc. Once the liquid hold-up is determined, the gas volume in the cell can be calculated.

It is important that properly tuned PVT data and a suitably tuned vertical lift correlation are used for the steady-state calculation. The model determines the amounts of free gas, oil and water in the tubing. These masses are preferably used in all further calculations unless otherwise specified by say an engineer. For example, the engineer may want to change these quantities for instance in the case where gas is bled off at the wellhead and further fluid influx from the well is instigated.

The key steady-state flowing data that will be used as the input parameters for the shut-in calculation are:

1. Well depth (bottom measured depth and true vertical depth), ft
2. Cell length (bottom measured depth), ft
3. Pressure, psig
4. Temperature, ° F.
5. Gas-oil interfacial tension, dyne/cm
6. Gas and liquid viscosities, cp
7. Gas and liquid hold-up, fraction
8. Gas and liquid densities, lb/ft$^3$
9. Tubing diameter, inch
10. Well angle from vertical, °

Figure 2:
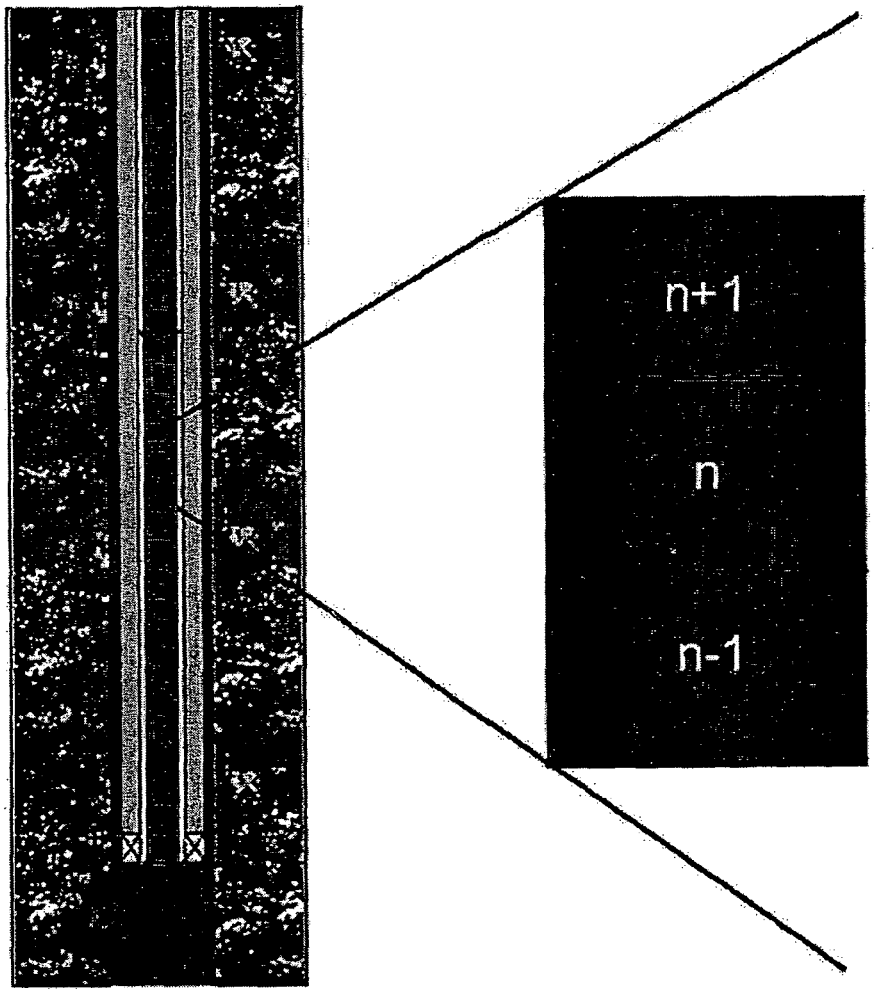
FIG. 2 is a schematic of the well.

Once the steady-state parameters have been obtained, the calculation of the shut-in well behaviour can be performed. The process is a multi-step process where the steps are preferably performed sequentially, the steps are:

1. PVT calculation module
2. Gas bubble rise velocity calculation module
3. Gas bubble size calculation module
4. Pressure build-up calculation module
5. Mass transfer rate calculation module
6. Gas volume rising calculation module
7. Reservoir fluid influx calculation module The applicant has also realised that in order to improve the accuracy of the calculations, the well is preferably discretised into n cells. A schematic example of a discretised well is shown in FIG. 2. The skilled man will understand the choice of the number of n cells will affect the accuracy of the calculations as well as the time required to run the simulations.

At step S104 the PVT calculations for the oil and gas are made. The key PVT properties of the fluids such as solution gas, formation volume factors, fluids' volumes and densities are calculated in each n cell.

For solution gas calculation, empirical correlations by Standing, Glasso, Marhoun and Vasquez-Beggs are widely used. In a preferred embodiment the correlation by Standing is used:

Solution gas, Rs, scf/stb $$RS = SGPG\left[\left(\frac{P}{18}\right)10^{0.0123API-0.00091T}\right]^{1.205} \tag{2}$$

where SGPG is the gas specific gravity of produced gas, P is the reservoir pressure, psig, API is the oil gravity, ° and T is the reservoir temperature, ° F.

Correlations known in the art such as those by Standing, Glasso, Lasater, Petrosky-Farshad and Macary are used for the oil formation volume factor calculation. In a preferred embodiment the correlation by Standing is used:

Oil formation volume factor, Bo, rb/stb $$PB = 18\left[\frac{Rsi}{SGPG}\right]^{0.83} \times 10^{a} \tag{3}$$

$$a = 0.00091(T) - 0.0123API \tag{4}$$

where PB is the reservoir bubble point pressure, psi, Rsi is the initial solution gas, scf/stb, SGPG is the gas specific gravity of produced gas, T is the reservoir temperature, ° F. and API is the oil gravity, °.

If P>=PB, Bo @ PB:

$$BOB = 0.972 + 0.000147\left[R\left(\frac{SGPG}{SGo}\right)^{0.5} + 1.25T\right]^{1.175} \tag{5}$$

If P<PB, BO @ P:

$$BO = 0.972 + 0.000147\left[Rs\left(\frac{SGPG}{SGo}\right)^{0.5} + 1.25T\right]^{1.175} \tag{6}$$

where Rs is the solution gas, scf/stb, SGPG is the gas specific gravity of produced gas, SGo is the oil specific gravity and T is the reservoir temperature, ° F.

The gas formation volume factor is calculated based on the real gas Equations of State (EoS).

Gas formation volume factor, Bg, rb/stb $$Bg = \frac{147}{520}\left[(T+460)\frac{z}{P}\right] \tag{7}$$

where T is the reservoir temperature, ° F., z is the gas compressibility factor (z=1 for a perfect gas) and P is the reservoir pressure, psig.

The fluids' densities are calculated from several semi-empirical correlations, such as correlations known in the art by Standing, Vasquez-Beggs and Ahmed. In a preferred embodiment the correlation by Standing is used:

Oil density, $\rho_o$, lb/ft$^3$ $$\rho_o = \frac{SGo \cdot 62.4 + \left(\frac{SGPG \cdot 0.0764 \cdot Rs}{5.614}\right)}{Bo} \tag{8}$$

$$SGo = \frac{141.5}{(131.5 + API)} \tag{9}$$

where SGPG is the gas specific gravity of produced gas, SGo is the oil specific gravity, Rs is the solution gas, scf/stb, Bo is the oil formation volume factor, rb/stb and API is the oil gravity, Gas density, $\rho_g$, lb/ft$^3$ $$\rho_g = \frac{SGPG \cdot 0.0764}{Bg} \tag{10}$$

where SGPG is the gas specific gravity of produced gas and Bg is the gas formation volume factor, rb/stb.

Once the PVT relations have been formulated, the gas bubble rise velocity is determined at step S106. In a two phase system (liquid and gas) the gas bubble rise velocity is determined by a number of factors such as size of the bubble, the viscosity of the continuous phase (liquid), the Reynolds's number, $Re'_e$, of the bubble. As the value of $Re'_e$ increases in various ranges, the shape of the bubble will change from a sphere with no circulation, a sphere with the gas circulating due to drag at the gas/liquid interface, and oblate spheroid, to an irregular mushroom-shape.

During shut-in, the gas in the well travels in both "bubble flow" and "slug flow" depending on the gas-liquid ratio which varies with depth. In "bubble flow", where the gas hold-up is low at the bottom of the shut-in well; the gas is distributed in the liquid in bubbles. As the gas hold-up increases towards the wellhead, the gas bubbles coalesce into "slugs" and move upward in "slug flow".

If the gas hold-up<0.25 (bubble flow), gas bubble rise velocity, $U_g$, m/s, is calculated from the known Harmathy expression:

$$U_g = 1.53 \cdot \left[g \cdot \theta_L \cdot \frac{(\rho_1 - \rho_g)}{\rho_l^2}\right]^{\frac{1}{4}} \tag{11}$$

where g is the gravity force, 9.81 m/s$^2$, $\theta_L$ is the gas-liquid interfacial tension, dynes/cm, $\rho_l$ is the liquid density, kg/m$^3$, and $\rho_g$ is the gas density, kg/m$^3$.

If gas hold-up>0.25 (slug flow), gas bubble rise velocity, $U_g$, m/s, is calculated from equation 12:

$$U_g = 0.35 \cdot \sqrt{g \cdot ID \cdot \frac{(\rho_l - \rho_g)}{\rho_l}} \cdot Dev \tag{12}$$

where g is the gravity force, 9.81 m/s$^2$, ID is the tubing diameter, m, $\rho_l$ is the liquid density, kg/m$^3$, $\rho_g$ is the gas density, kg/m$^3$, and $$Dev = \sqrt{\sin\left(\frac{incl \cdot \pi}{180}\right)} \cdot \left[1 + \cos\left(\frac{incl \cdot \pi}{180}\right)\right]^{1.2} \tag{13}$$

where incl is the degree of well inclination from vertical as preferably calculated from the steady-state equation.

As the gas bubble velocity is dependent on the gas bubble size, in order to increase the accuracy of the simulation the gas bubble size is calculated at step S108. The gas bubble size changes according to the physical conditions within the well and the concentration of gas in the liquid.

In particular it is desirable to consider if the conditions will lead to diffusion between the gas contained within the liquid to the gas contained within the gas bubble. It is found that a key factor in determining the gas bubble size is the Reynolds's number which determines the properties of the flow e.g. laminar, turbulent etc.

The calculations of gas bubble size start with an assumed gas bubble diameter, dg, ft. The gas Reynolds number, $Re'_g$ is then calculated from:

$$Re'_g = \frac{1488.21 \cdot \rho_l \cdot U_g \cdot d_g}{\mu_l} \tag{14}$$

where $\rho_l$ is the liquid density, lb/ft$^3$, $U_g$ is the gas bubble rise velocity, ft/sec, $d_g$ is the assumed gas bubble diameter, ft, and $\mu_l$ is the liquid viscosity, cp.

The actual gas bubble size is then calculated from the iteration between the gas Reynolds number and the gas bubble size equations 15 to 18:

For region (a): $10^{-4}$<Re'<0.2 (laminar flow)

$$d_g = \frac{-3}{g(\rho_g - \rho_l)}\sqrt{-2 \cdot g \cdot (\rho_g - \rho_l) \cdot U_g \cdot \mu_l} \tag{15}$$

For region (b): 0.2<Re'<500

$$d_g = \sqrt{-\frac{\mu_l \cdot U_g \cdot [1 + 0.15 \cdot (Re'_g)^{0.678}] \cdot 18}{(\rho_g - \rho_l) \cdot g}} \tag{16}$$

For region (c): 500<Re'<$2\times10^5$ $$d_g = -\frac{1}{3} \cdot U_g^2 \cdot \frac{\rho_l}{g(\rho_g - \rho_l)} \tag{17}$$

For region (d): Re'>2×5 (turbulent flow)

$$d_g = -0.075 \cdot U_g^2 \cdot \frac{\rho_l}{g(\rho_g - \rho_l)} \tag{18}$$

where $\rho_l$ is the liquid density, lb/ft$^3$, $\rho_g$ is the gas density, lb/ft$^3$, $U_g$ is the gas bubble rise velocity, ft/sec, g is the gravity force, 32.2 ft/s$^2$, $\mu_l$ is the liquid viscosity, cp, and $Re'_g$ is the gas Reynolds number. Preferably the stop condition for the iterative calculations between the Reynolds's number and the gas bubble size is when the assumed gas bubble diameter converged with the calculated gas bubble diameter in its respective flow region.

When the changes in the gas bubble size have determined, the next step is, preferably, to calculate the bottom-hole pressure build-up profile over the shut-in period.

In the preferred embodiment, to increase the accuracy of the simulation, the bottom-hole pressure build-up profile is required as an input to the mass transfer rate calculation. The build-up pressure plots of Homer and Miller-Dyes-Hutchinson (MDH) for wells draining from completely bounded systems can be generated using the dimensionless pressure, $p_D$, functions. Such plots are used to calculate the change in bottom-hole pressure with time. In the preferred embodiment, the following steps are used to calculate the MDH pressure at a given time, t, in order to produce an accurate pressure versus time profile, though in other embodiments other suitable methods may also be used:

1. Generate dimensionless time corresponding to area, $t_{DA}$:

$$t_{DA} = \frac{t_D r_w^2}{A} \tag{19}$$

where $r_w$ is the wellbore radius, ft, and A is the reservoir area, ft$^2$, and $t_D$ is the dimensionless time corresponding to wellbore radius:

$$t_D = \frac{0.000264kt}{\phi\mu c_t r_w^2} \tag{20}$$

where k is the reservoir permeability, mD, t is the shut-in time, hour, Φ is the porosity, fraction, μ is the liquid viscosity, cp, $c_t$ is the compressibility factor, psi$^{-1}$, and $r_w$ is the wellbore radius, ft.

2. Obtain Matthews, Brons and Hazebroek (MBH) dimensionless pressure, $p_{D(MBH)}$ from Table 1a and b. (See FIG. 4). The pressures vary according to the profile of the hole and the dimensionless time $t_{DA}$ as calculated above.
3. Generate dimensionless pressure applicable for both transient and semi-steady-state flow period, pD:

$$p_D = 2\pi t_{DA} + \frac{1}{2}\ln\frac{4t_D}{1.781} - \frac{1}{2}p_{D(MBH)}(t_{DA}) \tag{21}$$

where $t_{DA}$ is the dimensionless time corresponding to area, $t_D$ is the dimensionless time corresponding to wellbore radius, and $p_{D(MBH)}$ is the MBH dimensionless pressure corresponding to $t_{DA}$.

4. Generate dimensionless pressure for semi-steady-state flow, $p_D(t_{Di}+\Delta t_D)$:

$$p_D(t_{Di} + \Delta t_D) = 2\pi(t_{DA,i} + \Delta t_{DA}) + \frac{1}{2}\ln\left(\frac{4A}{1.781 C_A r_w^2}\right) \tag{22}$$

where $t_{DAi}$ is the dimensionless time corresponding to area and producing time, $\Delta t_{DA}$ is the dimensionless time corresponding to area and shut-in time, A is the reservoir area, ft$^2$, $c_A$ is the Dietz shape factor, psi$^{-1}$, and $r_w$ is the wellbore radius, ft.

5. Calculate the difference of dimensionless pressure, $\Delta p_D$:

$$\Delta p_D = p_D(t_{Di}+\Delta t_D) - p_{D(MBH)} \tag{23}$$

where $p_D(t_{Di}+\Delta t_D)$ is the dimensionless pressure for semi-steady-state flow, and $p_{D(MBH)}$ is the MBH dimensionless pressure as determined from the Table.

6. Generate build-up pressure, $P_{BU}$:

$$P_{BU} = P_{res} - \frac{\Delta p_D}{\left(\frac{7.08 \times 10^{-3}\, kh}{q\mu Bo}\right)} \tag{24}$$

where $P_{res}$ is the reservoir pressure, psi, $\Delta p_D$ is the difference of dimensionless pressure, k is the reservoir permeability, mD, h is the reservoir thickness, ft, q is the liquid production rate, stb/d, μ is the liquid viscosity, cp, and Bo is the oil formation volume factor, rb/stb.

The input requirement of the reservoir pressure in Equation 15 shows that the calculation procedure is iterative with the final calculated reservoir pressure as shown in FIG. 1. At step S126 the calculated reservoir pressure is an input of the pressure build-up calculation module of step S110 in subsequent calculations.

Once the bottom cell build-up pressure is obtained from the pressure build-up calculation module, the remaining build-up pressure in the rest of the n cells is calculated with an assumed pressure gradient, $P_1$ at step S112:

$$P_{BU,n+1} = P_{BU,n} - (P_1 \cdot L_c) \tag{25}$$

where $P_{BU,n}$ is the build-up pressure at the bottom node, psi, $P_1$ is the assume pressure gradient, psi/ft, and $L_c$ is the vertical cell length, ft.

The build-up pressure in all the n cells calculated from the assumed pressure gradient at step S112 is used as an input to determine the mass transfer rate at step S114.

Figure 3:
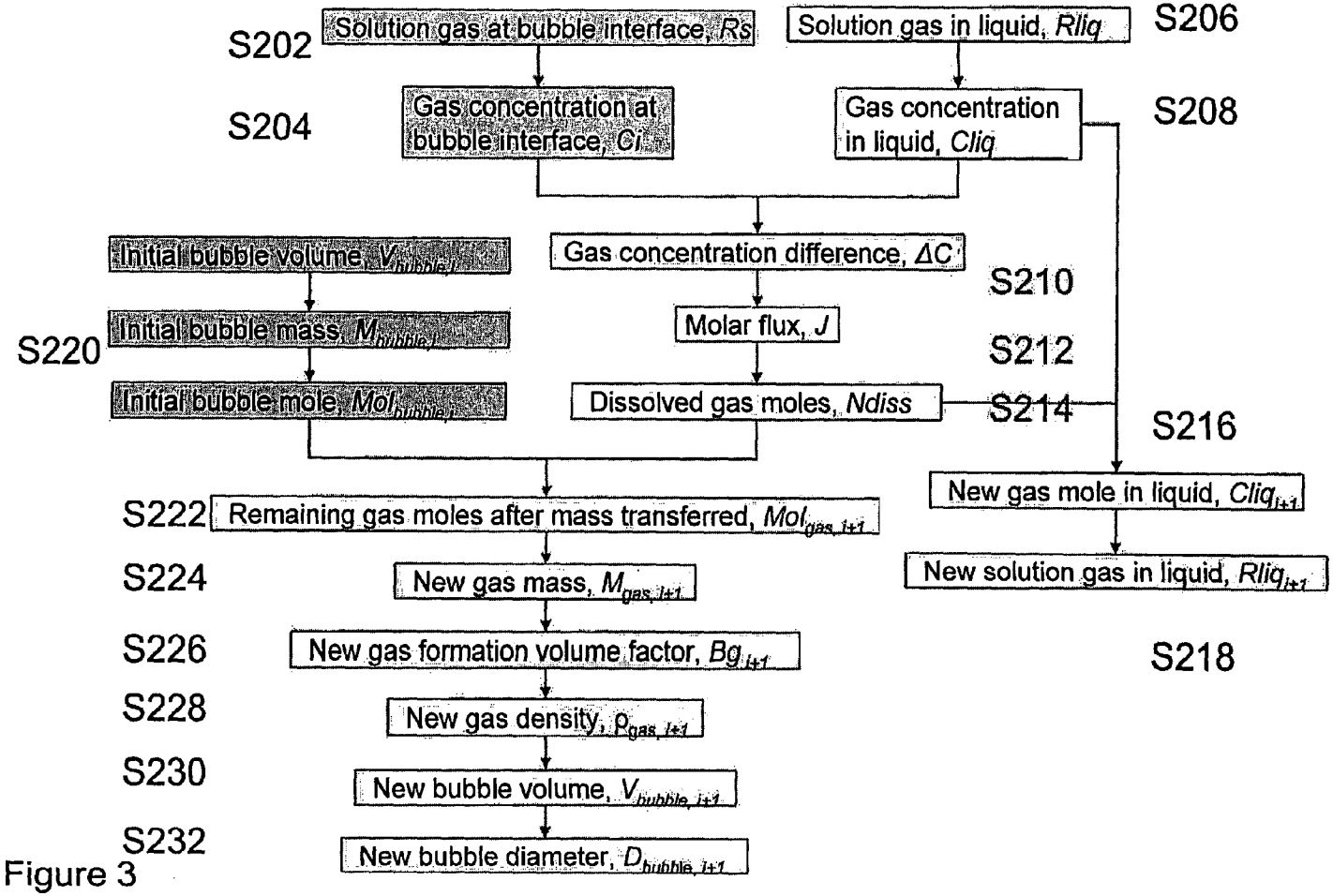
FIG. 3 is a flow diagram of the process to determine the mass transfer rate.
Figure 4A:
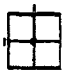
FIGS. 4*a* and 4*b* shows Tables 1a and 1b determining the MBH pressure.
Figure 4A:
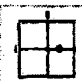
Figure 4A:
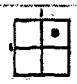
Figure 4A:
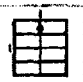
Figure 4A:
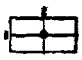
Figure 4A:
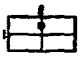
Figure 4A:
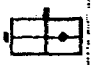
Figure 4A:
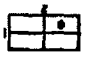
Figure 4A:
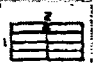
Figure 4B:
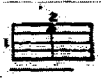
Figure 4B:
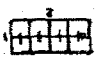
Figure 4B:
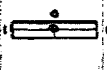
Figure 4B:
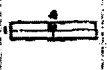
Figure 4B:
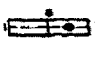
Figure 4B:
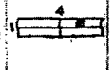
Figure 4B:
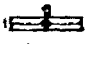
Figure 4B:
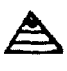

The calculation of the mass transfer rate is discussed in detail with respect to FIG. 3. The mass transfer rate between the dissolved gas in liquid phase and the gas bubble is calculated and the change in the gas bubble properties, such as the size and volume, are determined at step S114.

As the properties of the gas bubble change with time, the buoyancy will also change and a calculation of the volume balance is required taking into account the new volume of gas after each time step. By referring to the schematic diagram of a well discretised into numerous cells illustrated in a simple schematic in FIG. 2:

At step S116, the new volume of gas in each cell n after the first time step, $Vg_{n,i}$, m$^3$, can be calculated from:

$$Vg_{n,i} = Vg_{n,i-1} - Vg_{n\to n+1,i} + Vg_{n-1\to n,i} - Vg_{dissolved,i-1} \tag{26}$$

where $Vg_{n,i-1}$ is the initial gas volume, m$^3$, $Vg_{n\to n+1,i}$ is the volume of gas travelling upward from cell n to cell n+1, m$^3$, $Vg_{n-1\to n,i}$ is the volume of gas travelling upward from cell n−1 to cell n, m$^3$, and $Vg_{dissolved,i-1}$ is the volume of gas dissolved, m$^3$.

Therefore, the volume of gas in each cell n can be determined at step S116.

At step S118 the reservoir fluid influx is calculated.

When a well is shut-in, ideally the reservoir fluid influx rate is reduced to zero instantaneously when the producing formation is in the bottom of the well. However, since the well is shut-in at the surface, the flow from the reservoir into the well continues until such time the fluids in the wellbore are sufficiently compressed. This phenomenon is called reservoir fluid influx. The timescale is typically ranges from minutes to several hours depending on the nature of the fluid properties and the capacity of the flow string. The principle of superposition in time is used to relate the reservoir influx rate at time-step i+1, $q(t_{1+1})$, bbl/d (barrel per day), to the formation properties, wellbore shut-in pressure and shut-in time.

$$q(t_{i+1}) = q(t_i) + \frac{\Delta p(t_{i+1})}{m'[p_D(t_{D,i+1} - t_{D,i}) + s]} - \frac{1}{p_D(t_{D,i+1} - t_{D,i} + s)} \sum_{i=1}^{i} [q(t_i) - q(t_{i-1})][p_D(t_{D,i} - t_{D,i-1})] \tag{27}$$

where $q(t_i)$ is the reservoir influx rate at previous time-step $t_i$, bbl/d, $\Delta p(t_{i+1})$ is the reservoir and build-up pressure difference at time-step i+1, psi, $p_D$ and $t_D$ are the dimensionless time and pressure calculated as in pressure build-up calculation module, s is the skin factor, and $$m' = 162.6\frac{Bo\mu}{kh}$$

where Bo is the oil formation volume factor, rb/stb, μ is the liquid viscosity, cp, k is the reservoir permeability, mD, and h is the reservoir thickness, ft.

The input requirement of the reservoir pressure in the influx equation shows that the calculation procedure is iterative with the final calculated reservoir pressure as shown in FIG. 1. At step S126 the calculated reservoir pressure is an input of the reservoir fluid influx calculation module of step S118 in subsequent calculations.

Once steps S116 and S118 have been performed the pressure gradient throughout the well is calculated at step S120. The pressure gradient is obtained when the gas densities of each cell are known after the effect of mass transfer, gas bubble rising and reservoir influx has been determined. By determining the pressure gradient (i.e. the pressure difference in the n cells of the well), a pressure profile for the entire length of the well can be build.

At step S122 the difference in the assumed pressure $P_1$ and the determined pressure $P_2$ is determined and if it found to be greater than a tolerance value, in the preferred embodiment 0.05 psi/ft, steps S112, S114, S116 and S120 are repeated with the calculated value of $P_2$ from the initial calculation at step S120 being used as the assumed pressure gradient. This iterative loop is repeated until such time the tolerance value of $P_1-P_2$ is met. In further embodiments different tolerance values may be used.

If the tolerance condition is met at step S122, the process moves to step S124. If the process has not completed the time-step, the simulation continues by returning to step S106, the gas bubble rise velocity module, and the subsequent calculation including the iteration of pressure gradients etc., being used as the inputs for the next time step. The calculation is continued until the fluids reached equilibrium where the final pressure gradient throughout the whole length of the flow path is determined. The control point is preferably the wellhead pressure measured at the surface. The pressure response over time at the top cell of the well should match the wellhead pressure profile to ensure the accuracy of the calculation.

When the well has reached equilibrium and the model has accurately modeled the transitional behaviour of the well, an accurate determination of the reservoir pressure at shut-in can be made. When the model shows little or no change in physical conditions over successive time steps, it is an indication that the conditions in the well have reached equilibrium and the modeling can stop. In the preferred embodiment the condition to determine equilibrium is where the bottom-hole shut-in pressure at step S110 is equivalent to the reservoir pressure at step S126.

FIG. 3 is a flow diagram of the process to determine the mass transfer rate. There is shown the steps of determining: the concentration of solution gas at the bubble interface at step S202 in standard cubic foot per stock tank barrel; the gas concentration at the bubble interface at step S204 in mol per liter; the concentration of gas in the liquid at step S206 in standard cubic foot per stock tank barrel; the gas concentration in the liquid at step S208 in mol per liter; a gas concentration difference at step S210; the molar flux at step S212; the number of dissolved gas moles at step S216; the new value of number of gas moles in the liquid at step S216; the new concentration of solution gas in the liquid at step S218; determining the initial properties of the bubble at step S220; the remaining gas moles after transfer at step S222; the new gas mass at step S224; the new gas formation volume factor at step S226; the new gas density at step S228; the new bubble volume at step S230 and the new bubble diameter at step S232.

Therefore, the step of determining the mass transfer rate at step S114 requires the calculation of the number of moles of gas transferred from the liquid into the gas bubble at a given time. The change in gas volume is proportional to the change in mass and therefore allows for the calculation of the mass transfer rate between the gas bubble and the liquid.

At step S202 the solution gas at the bubble interface is given by:

$$Rs = SGPG\left[\left(\frac{P_{BU}}{18}\right)10^{0.0123API-0.00091T}\right]^{1.205} \tag{29}$$

where SGPG is the gas specific gravity of produced gas, $P_{BU}$ is the build-up pressure, psig, API is the oil gravity, °, and T is the reservoir temperature, ° F.

The gas molar volume for 1 mole of ideal gas is 22.4 $dm^3$ at standard condition (1 atm and 273.15 Kelvins). Therefore the amount of molar gas residing in the gas bubble interface/film from the solution gas, Rs can be determined. This molar gas is converted into gas concentration, Ci (mole/L) after the unit conversion (from scf/stb) and gas volume adjustment to the standard condition at 60° F. and 1 atm. Thus at step S204 the gas concentration at bubble interface, Ci, mol/ltr is given by:

$$Ci = Rs \cdot \frac{28.3}{159} \cdot \left(\frac{1}{22.4} \cdot \frac{273}{288}\right) \tag{30}$$

where Rs is the solution gas at bubble interface, scf/stb, 1 scf is equivalent to 28.3 liter, 1 stb is equivalent to 159 liter, chemical standard condition is at 1 atm, 273 K, and oil and gas standard condition is at 1 atm, 288K.

At steps S206 and S208 similar calculations are required to calculate the properties of the dissolved gas in liquid. At step S206 the solution gas in the liquid is given by Solution gas in liquid, Rliq, scf/stb $$Rliq = SGPG\left[\left(\frac{P}{18}\right)10^{0.0123API-0.00091T}\right]^{1.205} \tag{31}$$

where SGPG is the gas specific gravity of produced gas, P is the current pressure, psig, API is the oil gravity, °, and T is the reservoir temperature, ° F.

At step S208 the gas concentration in the liquid is given by: Gas concentration in liquid, Cliq, mol/ltr $$Cliq = Rliq \cdot \frac{28.3}{159} \cdot \left(\frac{1}{22.4} \cdot \frac{273}{288}\right) \tag{32}$$

where Rliq is the solution gas in liquid, scf/stb, 1 scf is equivalent to 28.3 liter, 1 stb is equivalent to 159 liter, chemical standard condition is at 1 atm, 273 K, and oil and gas standard, condition is at 1 atm, 288K.

The differences in the concentration of the gases in the liquid and the bubble will result in mass transfer between the two states. The Gas concentration difference, ΔC, mol/ltr calculated at step S210 is given by:

$$\Delta C = Ci - Cliq \tag{33}$$

where Ci is the gas concentration at bubble interface, mol/ltr, and Cliq is the gas concentration in liquid, mol/ltr.

At step S212 the molar flux is calculated. In the preferred embodiment the molar flux is then calculated based on the film theory. Film theory assumes the mass transfer system is at steady-state condition, which is with no convection or turbulence at the interface where the mass transfer occurs. It is expressed as Molar flux, J, kg mole/$m^2$ se:

$$J = D_{AB} \cdot \frac{\Delta C}{\delta} \tag{34}$$

where $D_{AB}$ is the gas-liquid diffusion coefficient, $m^2$/sec, ΔC is the gas concentration difference, mol/ltr, and δ is the gas bubble film thickness, m.

Preferably the gas-liquid diffusion coefficient, $D_{AB}$, is an input parameter obtain from diffusivity laboratory analysis with the actual crude samples. Though in other embodiments other values may be used, though this is not preferred as it is potentially not as accurate.

Therefore steps S202 to S212 allow for the calculation of the number of moles of gas diffused. At step S214 the calculation is applied over the surface area of the bubble allowing for a determination of the number of moles of gas diffused into or out of the liquid. The number of dissolved mole over a single bubble surface area at that particular time-step is calculated from:

Dissolved moles, $N_{diss}$, mole $$N_{diss} = J \cdot \Delta t \cdot (4\Pi r^2) \cdot 10^3 \tag{35}$$

where J is the molar flux, kg mole/$m^2$sec, Δt is the time step, sec, and r is the gas bubble diameter, m.

At steps S216 and S218 the new properties of the gas concentration in the liquid and number of moles in the liquid are calculated, simply by subtracting or adding (depending on the direction of mass transfer) the number of moles of gas, or concentration, transferred from the initial value. These new values are used in as the values at step S206 and S208 for an subsequent iterations of the model.

At step S220 the initial gas bubble properties are calculated including the volume, mass and number of moles. The gas density from correlation at step S104 is used to convert the gas volume to gas mass and the gas mixture molecular weight is used to convert the gas mass to number of moles.

The remaining number of moles of gas in the form of gas bubble is calculated at step S222, again by subtracting or adding (depending on the direction of mass transfer) the number of moles of gas transferred from the initial value. Likewise for the gas mass at step S224, gas formation value factor at step S226, gas density S228, bubble volume S230 and bubble diameter S232.

Therefore, the invention allows for the accurate simulation of the phase transition that occurs during well shut-in by considering important factors such as mass transfer from the bubble to liquid or from the liquid to the bubble, the non-instantaneous nature of the transition and the reservoir influx, a more accurate transient well modeling to obtain the reservoir pressure can be made.

Figure 5:
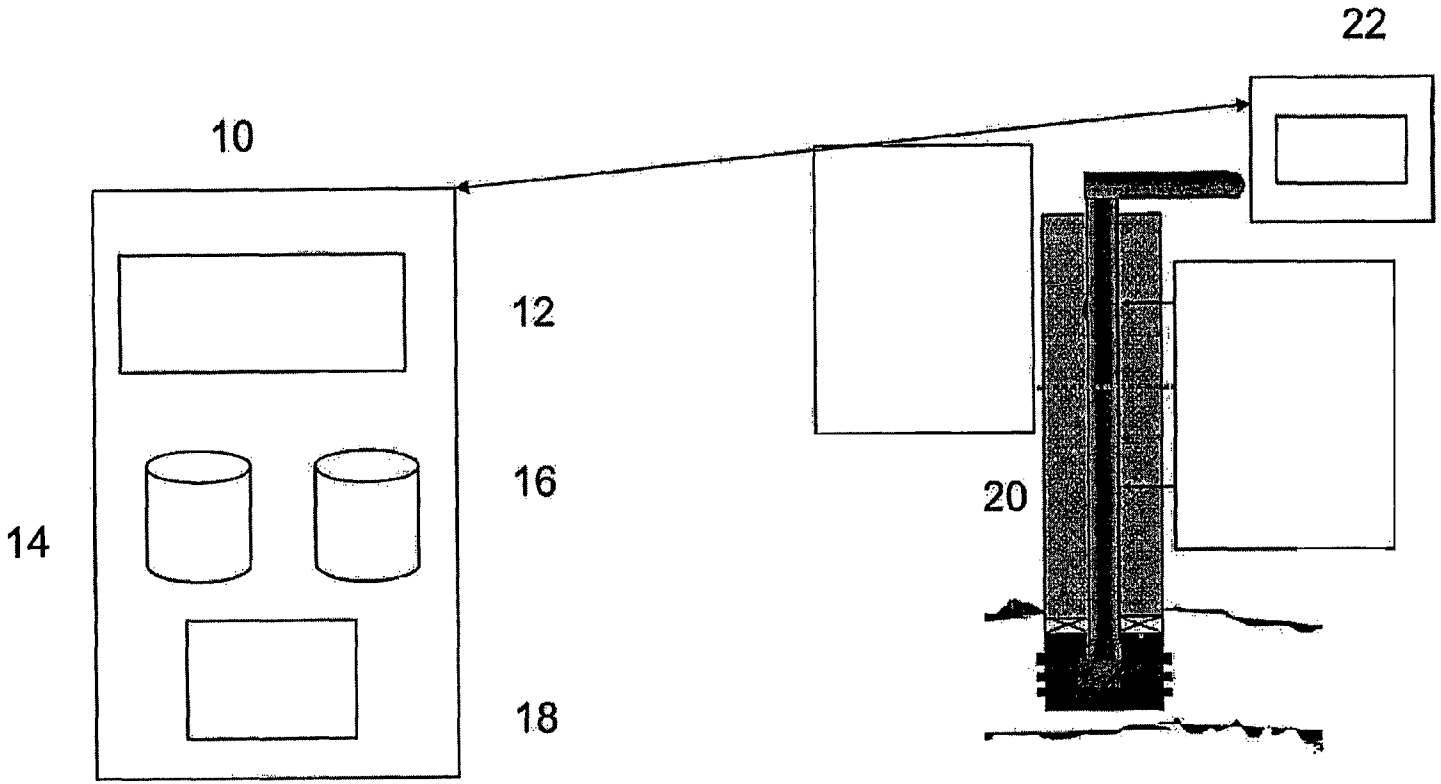
FIG. 5 is a schematic of the apparatus used in bottom-hole modeling.
Figure 6:
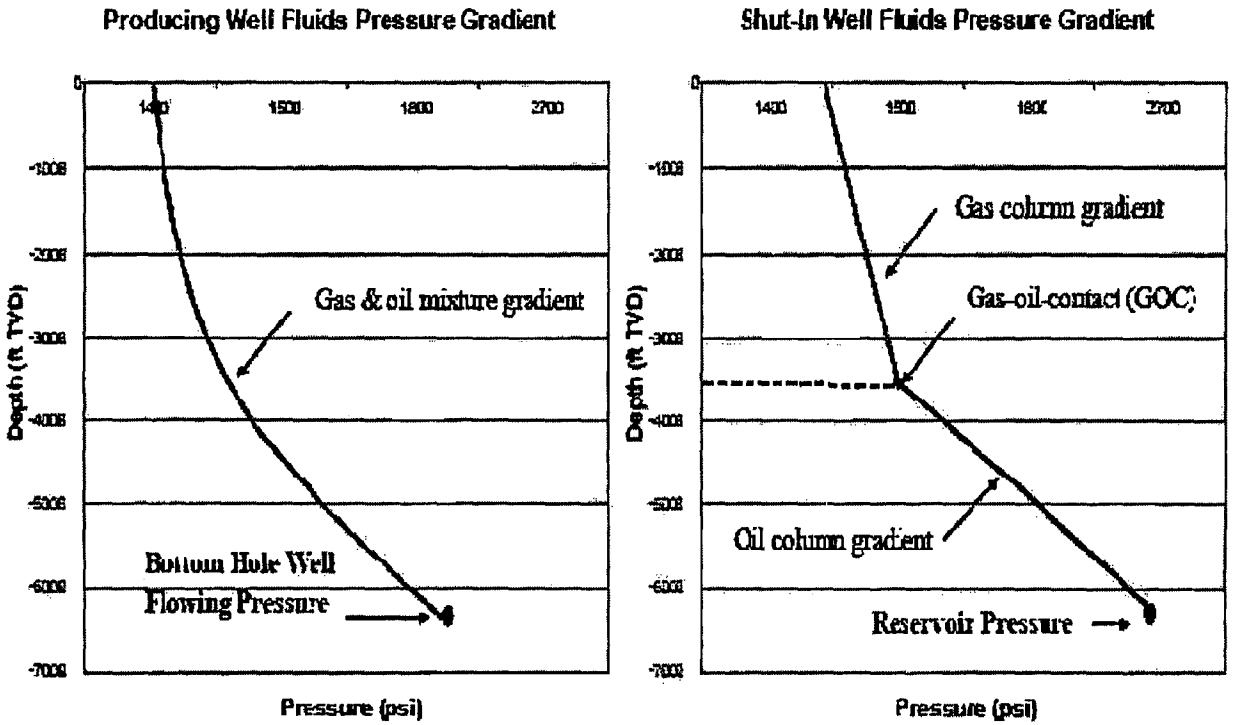
Figure 6 PRIOR ART

FIG. 5 shows a schematic diagram of the apparatus used in the modeling of the well during shut-in. There is shown a computer 10 comprising: a module which contains the modeling program 12; a RAM 14; a ROM 16; and a processor 18. There is also shown the well being modeled 20 and a gauge measuring the head pressure 22.

In FIG. 5 there is shown the program being run on a single known computer, such as a desktop of laptop, though in further embodiments the program may be run across a network of computers, or on a server.

The computer contains known elements such as ROM 16, RAM 14 a processor 18 etc. In the preferred embodiment, the computer 10 is in communication with a pressure gauge that measures the well head pressure 22 of the well being modeled 20. This allows the results of the model to be compared with the actual pressure data to ensure the accuracy of the model.

The invention claimed is:

1. A computer implemented method for determining a reservoir pressure in a shut-in well, the method comprising:

determining initial physical characteristics of the well;

determining properties of a gas bubble throughout the well;

calculating a dynamic mass transfer rate for the gas bubble over a period of time;

calculating physical fluid movement along the well;

calculating a rate of fluid influx from the reservoir;

determining a pressure gradient along at least part, or all, of the profile of the well using the dynamic mass transfer rate, physical fluid movement, and rate of fluid influx; and determining the reservoir pressure from a measure, or determination, of the well head pressure and the pressure gradient.

2. The method according to claim 1, further comprising determining a bottom-hole pressure build-up as a function of well shape.

3. The method according to claim 2, wherein the bottom-hole pressure build-up is calculated by:

determining a dimensionless pressure value that is based on the shape of the well; and determining a build-up pressure value based on the reservoir pressure and the dimensionless pressure value.

4. The method according to claim 3, wherein the dimensionless pressure value is determined as a Matthews, Brons, and Hazebroek value according to the shape of the hole.

5. The method according to claim 4, wherein the dimensionless pressure value is determined by $$p_D(t_{Di}+\Delta t_D)=2\pi(t_{DA,i}+\Delta t_{DA})+\frac{1}{2}\ln\left(\frac{4A}{1.781C_A r_w^2}\right)$$

where $t_{DAi}$ is the dimensionless time corresponding to area and producing time, $\Delta t_{DA}$ is the dimensionless time corresponding to area and shut-in time, A is the reservoir area, $ft^2$, $C_A$ is the Dietz shape factor, $psi^{-1}$, and $r_w$, is the wellbore radius, ft.

6. The method according to claim 3, wherein the bottom-hole pressure build-up is determined by $$P_{BU}=P_{res}-\frac{\Delta p_D}{\left(\frac{7.08\times10^{-3}\,kh}{q\mu Bo}\right)}$$

where $P_{res}$ is the reservoir pressure, psi, $\Delta p_D$ is the difference of dimensionless pressure, k is the reservoir permeability, mD, h is the reservoir thickness, ft, q is the liquid production rate, stb/d, μ is the liquid viscosity, cp, and Bo is the oil formation volume factor, rb/stb.

7. The method according to claim 1, further comprising:

dividing the well into a plurality of n cells;

determining initial relations between pressure, volume, and temperature for the well; and iteratively repeating the steps of determining the pressure gradient until such time that a condition, such as equilibrium, is met.

8. The method according to claim 1, wherein the rate of fluid influx from the reservoir is the difference between the reservoir pressure and the bottom-hole build-up pressure.

9. The method according to claim 1, wherein the determination of the dynamic mass transfer rate further comprises for an n cell the steps of:

determining the change in volume of the gas bubble as a result of diffusion of gas into, and out of, the liquid; and converting the determined change in gas volume to a change in gas mass.

10. The method according to claim 9, wherein the determination of the initial volume of the gas bubble is as a result of a previous calculation.

11. The method according to claim 9, wherein the change in volume is calculated by:

determining the concentration of dissolved gas in the liquid and the gas at the bubble interface;

calculating a concentration gradient between the dissolved gas in the liquid and the gas at the bubble interface and the resulting molar flux; and calculating the change in volume as a result of the number of moles of gas diffused into or out of the liquid as a measure of the molar flux and surface area of the bubble.

12. The method according to claim 1, wherein the determination of the dynamic mass transfer rate is based on the gas concentration gradient between the liquid and gas in the well.

13. The method according to claim 12, wherein the determination of the gas concentration gradient at a bubble interface is determined from $$Ci=Rs\cdot\frac{28.3}{159}\cdot\left(\frac{1}{22.4}\cdot\frac{273}{288}\right)$$

where Rs is the solution gas at bubble interface, scf/stb, 1 scf is equivalent to 28.3 liter, 1 stb is equivalent to 159 liter, chemical standard condition is at 1 atm, 273 K, and oil and gas standard condition is at 1 atm, 288K.

14. The method according to claim 12, wherein the determination of the gas concentration gradient in a liquid is determined from $$Cliq=Rliq\cdot\frac{28.3}{159}\cdot\left(\frac{1}{22.4}\cdot\frac{273}{288}\right)$$

where Rliq is the solution gas in liquid, scf/stb, 1 scf is equivalent to 28.3 liter, 1 stb is equivalent to 159 liter, chemical standard condition is at 1 atm, 273 K, and oil and gas standard condition is at 1 atm, 288K.

15. The method according to claim 12, wherein the determination of the gas concentration gradient of the dissolved gas in the liquid and the gas at the bubble interface is determined from ΔC=Ci−Cliq where Ci is the gas concentration at bubble interface, mol/ltr, and Cliq is the gas concentration in liquid, mol/ltr.

16. The method according to claim 12, wherein the determination of the gas concentration gradient is determined from $$J=D_{AB}\cdot\frac{\Delta C}{\delta}$$

where J is the molar flux, $D_{AB}$ is the gas-liquid diffusion coefficient, $m^2$/sec, ΔC is the gas concentration difference, mol/ltr, and δ is the gas bubble film thickness, m.

17. The method according to claim 1, wherein the dynamic mass transfer rate is determined as the number of moles of gas diffused into or out of the liquid.

18. The method according to claim 17, wherein the number of moles of diffused gas is determined from $N_{diss}=J\cdot\Delta t\cdot(4\Pi r^2)\cdot10^3$ where J is the molar flux, kg mole/$m^2$ sec, Δt is the time step, sec, and r is the gas bubble diameter, m.

19. The method according to claim 1, wherein the rate of fluid influx from the reservoir is determined as $$q(t_{i+1})=q(t_i)+\frac{\Delta p(t_{i+1})}{m'[p_D(t_{D,i+1}-t_{D,i})+s]}-\frac{1}{p_D(t_{D,i+1}-t_{D,i}+s)}\sum_{i=1}^{i}[q(t_i)-q(t_{i-1})][p_D(t_{D,i}-t_{D,i-1})]$$

where $q(t_i)$ is the reservoir influx rate at previous time-step $t_i$, bbl/d, $\Delta p(t_{i+1})$ is the reservoir and build-up pressure difference at time-step i+1, psi, $p_D$ and $t_D$ are the dimensionless time and pressure calculated as in pressure build-up calculation module; s is the skin factor, and $$m'=162.6\frac{Bo\mu}{kh}$$

where Bo is the oil formation volume factor, rb/stb, μ is the liquid viscosity, cp, k is the reservoir permeability, mD, and h is the reservoir thickness, ft.

20. The method according to claim 1, wherein determining the properties of a gas bubble includes a determination of a gas volume balance determined from $$Vg_{n,i}=Vg_{n,i-1}-Vg_{n\rightarrow n+1,i}+Vg_{n-1\rightarrow n,i}-Vg_{dissolved,i-1}$$

where $Vg_{n,i-1}$ is the initial gas volume, $m^3$, $Vg_{n\rightarrow n+1,i}$ is the volume of gas travelling upward from cell n to cell n+1, $m^3$, $Vg_{n-1\rightarrow n,i}$ is the volume of gas travelling upward from cell n−1 to cell n, $m^3$, and $Vg_{dissolved,i-1}$ is the volume of gas dissolved, $m^3$.

21. A non-transitory computer readable media containing computer executable instructions which when loaded upon a computer provides a method according to claim 1.

* * * * *